United States Patent [19]

Itami et al.

[11] Patent Number: 4,769,088

[45] Date of Patent: Sep. 6, 1988

[54] PROCESS FOR PRODUCING HOT-ROLLED STEEL SHEET HAVING HIGH $\bar{r}$ VALUE

[75] Inventors: Atsushi Itami; Kazuo Koyama; Hiroshi Katoh; Nobuhiko Matsuzu, all of Kimitsu, Japan

[73] Assignee: Nippon Steel Corporation, Tokyo, Japan

[21] Appl. No.: 11,824

[22] Filed: Feb. 6, 1987

[30] Foreign Application Priority Data

Feb. 18, 1986 [JP] Japan ..... 61-33646

[51] Int. Cl.[4] ..... C21D 8/02

[52] U.S. Cl. ..... 148/12 F; 148/12 C

[58] Field of Search ..... 148/12 F, 12 C, 12.1

[56] References Cited

U.S. PATENT DOCUMENTS 3,849,209 11/1974 Ishizaki et al. ..... 148/12 F

FOREIGN PATENT DOCUMENTS 55-97431 7/1980 Japan ..... 148/12 F 59-226149 12/1984 Japan .

*Primary Examiner*—Deborah Yee

*Attorney, Agent, or Firm*—Wenderoth, Lind & Ponack

[57] ABSTRACT

An $\bar{r}$ value of a hot-rolled steel sheet is enhanced by: a specific composition consisting of not more than 0.015 wt % of C, from 1.0 to 2.5 wt % of Mn, from 0.005 to 0.10 wt % of Al, from 0.01 to 0.06 wt % of Nb, from 0.01 to 0.1 wt % of Ti; and, controlled rolling, characterized by in the rough rolling, imparting, in a temperature range of from 980° to 1100° C., a heavy reduction of not less than 20% per pass to the steel sheet; completing a finishing rolling at from $Ar_3$ to 930° C. and maintaining a total reduction at a temperature of not more than $Ar_3+150°$ C. to not less than 90%; and, coiling at a temperature of from 600° to 800° C.

7 Claims, No Drawings

PROCESS FOR PRODUCING HOT-ROLLED STEEL SHEET HAVING HIGH $\bar{r}$ VALUE

BACKGROUND OF THE INVENTION

1. Field of the Invention

The present invention relates to a process for producing a hot-rolled steel sheet having a particular composition and having a high $\bar{r}$ value in the hot-rolled state.

2. Description of the Related Arts

Deep drawing is a fundamental forming technique in sheet forming, and a deep drawability, is an extremely important factor in the formability of a sheet. As is well known, the ruling factor for a deep drawability is the $\bar{r}$ value. Attempts have been made, therefore, to enhance the $\bar{r}$ value by controlling the texture by, for example, subjecting a steel sheet to cold-rolling and annealing. The $\bar{r}$ value is calculated by the equation:

$$r=(r_L+r_T+2r_D)/4,$$

in which $r_L$, $r_T$, and $r_D$ are the Lankford values $$\text{Plastic anisotropy ratio} = \frac{\text{width strain}}{\text{thickness strain}}$$

in the parallel direction, the transverse direction, and the 45-degree direction to the rolling direction, respectively.

It has been established that the $\bar{r}$ value of a hot-rolled steel sheet is low (~ 0.9). This is because the crystal orientation in the as hot-rolled state is random and, hence, a texture advantageous for the $\bar{r}$ value cannot be obtained. Accordingly, to obtain a steel sheet having a high $\bar{r}$ value, cold-rolling and annealing are necessary. It has been believed that this cold-rolling and annealing is the only method that can be used for ensuring the $\bar{r}$ value.

Requests by the users for an enhanced formability of a hot-rolled steel sheet increase steadily, but the formability of a hot-rolled steel sheet attained by the conventional processes has reached a limit and, hence, such requests cannot be met by these conventional processes. The necessity, therefore, has arisen for the development of a hot-rolled steel sheet having novel properties.

There are a number of production methods used for producing a hot-rolled steel sheets and imparting a high formability to the sheets, in which the solute [C] and [N], which are detrimental to the aging property, are removed by the vacuum-degassing method or fixed by Ti, Nb, B, Al, and the like, thereby attaining IF (interstitial free), P and S, which are detrimental to the forming, are reduced as possible, and such IF steel with low P and S is rolled under an appropriate hot-rolled condition, thereby producing a hot-rolled steel sheet having a low YP, a high elongation, and improved, stretch flange- and bulging-properties. The $\bar{r}$ values attained by these production methods are approximately 0.90 at the highest, and these methods cannot provide a hot-rolled steel sheet having a high $\bar{r}$ value.

The processes for producing a hot-rolled steel sheet having a high $\bar{r}$ value known, for example, in Japanese Unexamined Patent Publication No. 59-226,149 and Japanese Patent Application No. 59-124,751, involve warm-rolling (+oil lubrication) during the finishing rolling stage of the IF steel. However, in these processes, the annealing is indispensable and the rolling method is technically very difficult.

SUMMARY OF THE INVENTION

The present inventors investigated a method for producing a hot-rolled steel sheet having a high r value by means of methods completely different from the prior art process described above.

As a result of the investigations, the present inventors discovered that, to obtain a high $\bar{r}$ value, the composition should be specific and the rolling at the austenite region should be controlled. More specifically, the method for producing a hot-rolled steel sheet having a high $\bar{r}$ value is characterized by: heat-charging a steel consisting of not more than 0.015 wt % of C, from 1.0 to 2.5 wt % of Mn, from 0.005 to 0.10 wt % of Al, from 0.01 to 0.06 wt % of Nb, from 0.01 to 0.1 wt % of Ti, and Fe and unavoidable impurities, into a reheating furnace and heating to a temperature of not less than 1150° C., and then rough rolling the steel, or rough rolling the steel as a hot section without heating in a reheating furnace; in the rough rolling, imparting, in a temperature range of from 980° to 1100° C., a heavy reduction of not less than 20% per pass to the steel sheet; completing a finishing rolling at from $Ar_3$ to 930° C. and maintaining a total reduction at a temperature of not more than $Ar_3$+150° C. to 90% or more; and, coiling at a temperature of from 600° to 800° C. The essence of this process resides in the point that the high Mn-IF-steel free of the solute [C, N] is subjected to a heavy reduction while in a particular temperature range, followed by cooling, and is then coiled while in a particular temperature range.

The reasons for limiting the components of the steel and the hot-rolling conditions are described hereinafter.

To obtain IF, the C content is desirably as low as possible. One of the features of the steel according to the present invention is a high Mn. Due to the Mn addition, a pick-up of C occurs during the melting for steelmaking, with the result that the C amount inevitably increases. Taking this into consideration, the upper limit of the C amount is set as 0.015 wt %. A preferred range is from 0.003 to 0.008 wt %.

Mn is an important element for the present invention. As is well known, Mn is a strengthening element in steel, but Mn has been decreased to a level as low as possible in the prior art methods for producing a hot-rolled steel sheet having a high formability. The Mn is intentionally added in the present invention, because Mn is the only element, except for C, which can lower the steel transformation temperature without seriously degrading the steel properties. Mn is, therefore, an element which is very effective for allowing the austenite to remain not recrystallized during the finishing rolling stage. To achieve this object, at least 1.0 wt % of Mn is necessary. The upper limit of 2.5 wt % is a level at which no special considerations in the melting for steelmaking is necessary. A preferred range is from 1.0 to 2.0 wt %.

Al is necessary as the deoxidizing agent, but the deoxidizing effect is not generated at an Al amount of less than 0.005 wt %. Accordingly, the upper limit of Al is set as 0.10 wt %, because the effect of deoxidizing agent is most satisfactory at this amount.

Nb is an important element for the present invention, as is Mn. In the prior art method for producing a hot-rolled steel sheet having a high formability, Nb is added only for fixing [C] and [N], which are detrimental to the aging property, as is Ti. In the prior art method for producing a hot-rolled steel sheet having a high formability, the reheating temperature is, therefore, set low. The reason for adding Nb according to the present invention is different from that of the prior art; that is, Nb is used in the present invention to positively utilize its retarding effect on austenite recrystallization. Evidently, to realize such an effect, the heating temperature in the case of reheating for hot-rolling, or temperature history of a slab until the rolling step in the case of direct rolling, is important. The lower limit of Nb for attaining the retardation of austenite recrystallization is 0.01 wt %. The upper limit of Nb is 0.06 wt %, which is sufficient for attaining the above mentioned retardation. A preferred range of Nb is from 0.02 to 0.05 wt %.

Ti is added for fixing C as well as N and S as the unavoidable impurities. The amount of 0.01 wt % of Ti is necessary, and an upper limit of 0.1 wt % is set from the viewpoint of melting in the steelmaking.

In a case where a further enhanced $\bar{r}$ value and formability are required, P and S should be reduced to a level as low as possible. Particularly, P should be low to depress the $Ar_3$. A preferred range of P is less than 0.01 wt %. A preferred range of S for enhancing the formability is less than 0.006 wt %.

Since Si is an element which enhances the transformation temperature, particularly $Ar_3$, the amount thereof should be small, desirably a level as low as possible. A preferred range of Si is not more than 0.05 wt %.

A casting or a steel section, e.g., a slab, may be charged in a rolling step, as a hot section. The charging temperature, however, must be such that at least one heavy reduction of 20% or more per pass can be imparted in a temperature range of from 980° to 1100° C. during the rough rolling. When charging in a reheating furnace, the withdrawal temperature from a reheating furnace must be 1150° C. or more for dissolving Nb into the solid solution.

In the rough rolling, the heavy reduction of 20% or more per pass must be imparted in a temperature range of from 980° to 1100° C. at least once during the rough rolling. The rough rolling in the present invention is significant in that the rough rolling is carried out in a recrystallization range of austenite, thereby refining the $\gamma$ grains. The temperature of 980° C. or more is necessary to attain this object, since at a temperature lower than 980° C., the rolling is not carried out in a recrystallization region. On the other hand, if the rough rolling is completed at a temperature exceeding 1100° C., only an enlargement of the austenite grains occurs. In addition, the heavy reduction of 20% or more per pass must be carried out at least once within the above mentioned temperature range, since otherwise a desired texture cannot be attained.

The finishing rolling must be completed at $Ar_3 \sim 930°$ C. The $Ar_3$ herein indicates the temperature, at which the structure (formed ferrite or the like) due to rolling in the $\alpha$ region does not appear. This is detected by a photograph of a structure of a steel strip at a temperature corresponding to the finishing temperature of the rolling. Unless the finishing temperature of the rolling is specified as described above, a high $\bar{r}$ value cannot be obtained even by the addition of Nb and Mn. The above mentioned temperature range is that of the non-recrystallization region of austenite, and is broadened by the addition of Nb and Mn. The most preferred temperature is directly above $Ar_3$.

The reduction in the hot-rolling must be high. If the total reduction at a temperature range of not more than $Ar_3+150°$ C. is less than 90%, the desired $\bar{r}$ value cannot be obtained. That is, this temperature range is the non-recrystallization temperature range of austenite, and a strong texture of austenite is obtained by enhancing the reduction in this temperature range. The temperature of $Ar_3+150°$ C. is set because this temperature, which is lower than the lowest temperature of austenite recrystallization, is necessary for a stable operation. The most desirable finishing rolling method is an isothermal rolling directly above $Ar_3$.

The coiling temperature must be 600° C. or higher, since the self-annealing in the coiling stage due to a high-temperature coiling is utilized to enhance the $\bar{r}$ value. The coiling at at least 600° C. is effective for realizing the effect of self annealing. A preferred coiling temperature is from 700° to 800° C. The ductility is also preferably enhanced by a high-temperature coiling. The coiling at a temperature exceeding 800° C. is very difficult in the light of ease of operation, and therefore the upper limit of the coiling is 800° C.

The cooling condition on a run out table may be the ordinary condition. Preferably, a rapid cooling of not less than 30° C./sec is carried out within 2 seconds after the completion of finishing rolling. This rapid cooling is advantageous for forming the texture.

The present invention is carried out by maintaining the numerical limitations as described above. However, with regard to a high-temperature coiling for utilizing a self annealing to improve the $\bar{r}$ value and elongation, in the cases of operating problems, the coiling temperature may become too low to obtain a desired $\bar{r}$ value. In this case or when obtaining a further enhanced formability, the batch annealing may be carried out. The finishing steps after forming a hot-rolled coil may be carried out by the ordinary methods, including skin-passing and levelling.

EXAMPLES

The steels having the composition shown in Table 1 were melted in a laboratory and subjected to rolling experiments subsequent to pulling out a mold. A facility used for the laboratory rolling is that can reproduce the actual machine with a high accuracy.

In Table 1, Nos. 1 and 2 are inventive steels, while Mn of No. 3, Nb of No. 4, Ti of No. 5, and C of No. 6 are outside the inventive range.

TABLE 1

| | | Chemical composition and $Ar_3$ (wt %) | | | | | | | |
|---|---|---|---|---|---|---|---|---|---|
| | No. | C | Si | Mn | P | S | Ti | Nb | $Ar_3$ [°C.] |
| Invention | 1 | 0.0042 | 0.026 | 1.54 | 0.0021 | 0.0009 | 0.081 | 0.028 | 805 |
| Invention | 2 | 0.0080 | 0.042 | 1.53 | 0.0151 | 0.0041 | 0.068 | 0.024 | 815 |
| Comparative | 3 | 0.0044 | 0.026 | 0.10 | 0.0021 | 0.0005 | 0.078 | 0.027 | 900 |
| Comparative | 4 | 0.0044 | 0.025 | 1.52 | 0.0021 | 0.0072 | 0.080 | — | 810 |
| Comparative | 5 | 0.0041 | 0.031 | 1.12 | 0.0035 | 0.0012 | — | 0.025 | 840 |

TABLE 1-continued

| | No. | Chemical composition and $Ar_3$ (wt %) C | Si | Mn | P | S | Ti | Nb | $Ar_3$ [°C.] |
|---|---|---|---|---|---|---|---|---|---|
| Comparative | 6 | 0.0290 | 0.025 | 1.11 | 0.0022 | 0.0009 | 0.088 | 0.026 | 825 |

TABLE 2

| Sheet No. | Hot-Rolling Method and Mechanical Properties FT (°C.) | CT (°C.) | YP (kgf/mm²) | TS (kgf/mm²) | El (%) | $r_L$ | $r_T$ | $r_D$ | $\bar{r}$ |
|---|---|---|---|---|---|---|---|---|---|
| 1-A | 841 | 710 | 29.8 | 41.0 | 42.1 | 0.75 | 0.81 | 1.98 | 1.38 |
| 2-A | 835 | 704 | 31.7 | 44.0 | 39.8 | 0.76 | 0.86 | 2.01 | 1.41 |
| 3-A | 842 | 694 | 26.1 | 35.1 | 44.1 | 0.83 | 0.89 | 1.10 | 0.98 |
| 4-A | 839 | 698 | 28.9 | 40.1 | 38.1 | 0.85 | 0.69 | 1.15 | 0.96 |
| 5-A | 845 | 718 | 27.1 | 36.5 | 43.1 | 0.79 | 0.67 | 1.21 | 0.97 |
| 6-A | 829 | 720 | 29.9 | 42.7 | 39.8 | 0.68 | 0.52 | 1.28 | 0.94 |

Each steel was heated to 1200° C. (in terms of the heating temperature of a furnace), rough rolled by 3 passes (20-25-25%) at a temperature of from 950° to 1100° C., subjected to a reduction of 92% in total at a temperature range of from $Ar_3$ to $Ar_3+150°$ C., finished at the FT given in Table 2, and coiled at the CT given in Table 2. The mechanical properties of the steels are given in Table 2. Steels Nos. 1 and 2 exhibit the $\bar{r}$ value which could not heretofore have been obtained for carbon steels in the as rolled state.

The influence of finishing temperature of rolling upon the mechanical properties of steels Nos. 1 and 2 was investigated. The results are given in Table 3. The alphabet suffixes in the tables are used to distinguish the sheets from one another.

FT means the finishing temperature of the rolling, and CT means the coiling temperature.

TABLE 3

| Sheet No. | Hot-Rolling Method and Mechanical Properties FT (°C.) | CT (°C.) | YP (kgf/mm²) | TS (kgf/mm²) | El (%) | $r_L$ | $r_T$ | $r_D$ | $\bar{r}$ | Remarks |
|---|---|---|---|---|---|---|---|---|---|---|
| 1-B | 789 | 698 | 31.5 | 43.9 | 38.3 | 0.51 | 1.35 | 1.13 | 1.03 | Comparative Method |
| 1-A | 841 | 710 | 29.8 | 41.0 | 42.1 | 0.75 | 0.81 | 1.98 | 1.38 | Inventive Method |
| 1-C | 862 | 702 | 29.1 | 41.0 | 42.3 | 0.77 | 0.89 | 2.03 | 1.43 | " |
| 1-D | 905 | 721 | 28.1 | 40.5 | 43.0 | 0.79 | 0.77 | 2.00 | 1.39 | " |
| 1-E | 951 | 709 | 21.3 | 40.1 | 41.9 | 0.61 | 0.69 | 1.51 | 1.08 | Comparative Method |
| 1-F | 850 | 410 | 35.9 | 48.2 | 32.1 | 0.68 | 0.88 | 1.40 | 1.09 | " |
| 2-B | 770 | 695 | 32.6 | 45.9 | 33.5 | 0.59 | 1.23 | 1.17 | 1.01 | " |
| 2-A | 835 | 704 | 31.7 | 44.0 | 39.8 | 0.75 | 0.90 | 1.99 | 1.41 | Inventive Method |
| 2-C | 849 | 721 | 30.9 | 42.9 | 40.7 | 0.73 | 0.87 | 1.96 | 1.38 | " |
| 2-D | 903 | 719 | 30.7 | 43.0 | 40.2 | 0.69 | 0.83 | 1.96 | 1.36 | " |
| 2-E | 981 | 720 | 30.7 | 42.8 | 40.1 | 0.62 | 0.90 | 1.26 | 1.01 | Comparative Method |
| 2-F | 847 | 405 | 36.7 | 49.1 | 30.1 | 0.69 | 1.09 | 1.29 | 1.07 | " |

The results hereinabove were evidently the basis for setting the temperature range of the finishing rolling according to the present invention.

The influence of the reduction of rough rolling and finishing rolling upon the mechanical properties were investigated. The results are shown in Table 4. In Table 4, the reduction of rough rolling indicates that at each pass in a temperature range of from 980° to 1100° C., while the reduction of finishing rolling indicates the total reduction at not more than $Ar_3+150°$ C. (FT 850° C., CT 710° C.).

TABLE 4

| Sheet No. | Rolling Reduction at Rough and Finishing Rolling and Mechanical Properties: Reduction at Rough Rolling (%) | Reduction at Finishing Rolling (%) | $r_L$ | $r_T$ | $r_D$ | $\bar{r}$ |
|---|---|---|---|---|---|---|
| 1-G | 10-15-10 | 92 | 0.89 | 0.77 | 1.21 | 1.02 |
| 1-H | 10-15-10 | 92 | 0.79 | 0.71 | 1.41 | 1.08 |
| 1-I | 20-25-25 | 92 | 0.84 | 0.72 | 2.00 | 1.39 |
| 1-J | 20-25-25 | 33 | 0.88 | 0.76 | 1.32 | 1.07 |

Remarks:
Rough rolling temperature of sheet No. 1-G: more than 1100° C. ~ 1200° C.

As is apparent hereinabove, the rolling reduction in each steps is an important factor in the present invention.

The objective steel of the present invention is an IF steel having a non-aging property and high ductility. The steel produced according to the present invention has a high strength of 40 kgf/mm² or more. One of the features of the steel obtained by the method according to the present invention is that it has a high $\bar{r}$ value in the directions of 45 degree. The steel obtained by the method of the present invention is, therefore, appropriate for drawing a rectangular cylinder. The hot-rolled steel according to the present invention has an outstanding formability and can be used for various applications.

We claim:

1. A method for producing a hot-rolled steel sheet having a high $\bar{r}$ value which comprises: charging a steel consisting of not more than 0.015 wt % of C, from 1.0 to 2.5 wt % of Mn, from 0.005 to 0.10 wt % of Al, from 0.01 to 0.06 wt % of Nb, from 0.01 to 0.1 wt % of Ti, and Fe and unavoidable impurities into a reheating furnace and heating to a temperature of not less than 1150° C. and then rough rolling the steel, or rough rolling the steel as a hot section without heating in a reheating furnace; in the rough rolling, imparting, in a temperature range of from 980° to 1100° C., a heavy reduction of not less than 20% per pass to the steel sheet; completing a finishing rolling at from $Ar_3$ to 930° C. and maintaining a total reduction at a temperature of not more than $Ar_3+150°$ C. to not less than 90%: and, coiling at a temperature of from 600° to 800° C.

2. The method according to claim 1, wherein the C content is from 0.003 to 0.008 wt %.

3. The method according to claim 1, wherein the Mn content is from 1.0 to 2.0 wt %.

4. The method according to claim 1, wherein the Nb content is from 0.02 to 0.05 wt %.

5. The method according to claim 2, wherein P and S as the unavoidable impurities are less than 0.01 wt % and less than 0.006 wt %, respectively.

6. The method according to claim 3, wherein P and S as the unavoidable impurities are less than 0.01 wt % and less than 0.006 wt %, respectively.

7. The method according to claim 4, wherein P and S as the unavoidable impurities are less than 0.01 wt % and less than 0.006 wt %, respectively.

* * * * *